US012305554B2

(12) United States Patent
Vijayaraman et al.

(10) Patent No.: US 12,305,554 B2
(45) Date of Patent: May 20, 2025

(54) DEVICE FOR TREATING EXHAUST GASES FROM A VEHICLE AND A METHOD TO OPERATE THE SAME

(71) Applicant: INICIOTEK PRIVATE LIMITED, Chennai (IN)

(72) Inventors: Jaji Vijayaraman, Chennai (IN); Sivakumar R, Chennai (IN); Venugopal, Chennai (IN); Feroskhan M, Chennai (IN); Tamil Selvan P, Chennai (IN); Sreekanth M, Chennai (IN)

(73) Assignee: INICIOTEK PRIVATE LIMITED (IN)

( * ) Notice: Subject to any disclaimer, the term of this patent is extended or adjusted under 35 U.S.C. 154(b) by 0 days.

(21) Appl. No.: 18/422,157

(22) Filed: Jan. 25, 2024

(65) Prior Publication Data

US 2025/0035022 A1 Jan. 30, 2025

(51) Int. Cl.
*F01N 3/01* (2006.01)
*F01N 3/08* (2006.01)

(52) U.S. Cl.
CPC ..... *F01N 3/0892* (2013.01); *F01N 3/01* (2013.01); *F01N 2340/02* (2013.01); *F01N 2900/0422* (2013.01)

(58) Field of Classification Search
CPC ..... F01N 3/0892; F01N 2240/28
See application file for complete search history.

(56) References Cited

U.S. PATENT DOCUMENTS

| | | | | |
|---|---|---|---|---|
| 6,482,368 | B2 | 11/2002 | Hemingway et al. | |
| 7,298,092 | B2 | 11/2007 | Malik et al. | |
| 2006/0070372 | A1* | 4/2006 | Lucas | B01D 53/32 60/275 |

FOREIGN PATENT DOCUMENTS

| | | | | |
|---|---|---|---|---|
| CN | 109113841 | A * | 1/2019 | F01N 3/01 |
| CN | 111405741 | A * | 7/2020 | |
| EP | 1642633 | A1 | 4/2006 | |
| ES | 2280920 | T3 | 9/2007 | |
| GB | 2605212 | A * | 9/2022 | B01D 53/32 |

* cited by examiner

*Primary Examiner* — Jonathan R Matthias
(74) *Attorney, Agent, or Firm* — Jason C. Cameron

(57) ABSTRACT

A device 100 for treating exhaust gas from a vehicle is disclosed. The device includes a chamber 102, a plurality of electrodes 104, and a pulse controller 108. The chamber is configured to allow at least one of burning and ionization of a plurality of combustible constituents present in the exhaust gas to pass through the chamber. Each pair of the plurality of electrodes is positioned opposite to each other in the chamber with a predetermined gap and generate a plurality of plasma arcs 106. The plasma arc ionizes the exhaust gas to reduce emissions as the exhaust gas exits from a tail pipe of the vehicle thereby controlling the emissions of the vehicle. The pulse controller steps-up a predetermined voltage as an input voltage, controls the time required for energization of one pair of electrodes at a time, and control duration of a plasma arc inside the chamber.

6 Claims, 5 Drawing Sheets

DEVICE FOR TREATING EXHAUST GASES FROM A VEHICLE AND A METHOD TO OPERATE THE SAME

CROSS-REFERENCE TO RELATED APPLICATION

This Application claims priority from a Patent application filed in India having Patent Application No. 202341051065, filed on Jul. 28, 2023, and titled "A DEVICE FOR TREATING EXHAUST GASES FROM A VEHICLE AND A METHOD TO OPERATE THE SAME."

FIELD OF INVENTION

Embodiments of a present disclosure relate to devices for treatment of gases, and more particularly to a device for treating exhaust gases from a vehicle and a method to operate the same.

BACKGROUND

Air pollution is the contamination of air due to the presence of substances in the atmosphere that are harmful to the health of humans and other living organisms. The main cause of air pollution is the harmful gases present in the air. Additionally, the major pollutants are released as emissions from vehicle after fuel combustion. The pollutants released are carbon monoxide (CO), nitrogen oxides (NOx), photochemical oxidants, air toxics, particulate matter (PM), hydrocarbon (HC), oxides of sulphur (SO2), polycyclic aromatic hydrocarbons (PAHs), and the like. The Automotive emission norms are currently at the level at India is of an emission standard equivalent to European emission standard Euro-6. This standard at India is for automotive tail pipe exhaust emission.

Currently, the existing solutions includes electric vehicles, hydrogen powered vehicles, hydrogen fuel cell, and the like. Although these are solutions to avoid emission, the use Internal Combustion Engine (ICE) vehicles is still prevalent. Further, the existing solutions affect the performance of the vehicle engine. Currently, there are no solutions for controlling emissions of gases that are exhausted reduce the quantity of CO, CO2, NOx and particulate matter emitted to the atmosphere by internal combustion engine operations.

Currently, there is a need of technologies or solutions for Internal Combustion Engine (ICE) area to reduce the emissions from a vehicle. Hence, there is a need for a device for treating exhaust gases from a vehicle and a method to operate the same which addresses the aforementioned issues.

OBJECTIVE OF THE INVENTION

An objective of the present invention is to provide a device for treating harmful exhaust gases that are emitted from a vehicle thereby reducing air pollution.

Another objective of the present invention is to provide plasma are electrodes positioned in the exhaust pipe of a vehicle to maximize burning or ionization of combustible constituents in the exhaust gases.

Yet another objective of the invention is to provide a compact device for fitting in a small space and adaptable to the existing automobile exhaust tailpipe packaging.

BRIEF DESCRIPTION

In accordance with one embodiment of the disclosure, a device for treating exhaust gas from a vehicle is provided.

The device includes a chamber, a plurality of electrodes, and a pulse controller. The chamber is configured to allow at least one of burning and ionization of a plurality of combustible constituents present in the exhaust gas to pass through the chamber. The plurality of electrodes is positioned in the chamber. Each pair of the plurality of electrodes is positioned opposite to each other with a predetermined gap between each electrode of the pair plurality of electrodes. The plurality of electrodes is arranged in a direction perpendicular to the direction of the exhaust gas flow. The plurality of electrodes is configured to generate a plurality of plasma arcs upon energizing the plurality of electrodes. The plasma are ionizes the exhaust gas to reduce emissions as the exhaust gas exits from a tail pipe of the vehicle thereby controlling the emissions of the vehicle. The pulse controller is electronically connected to the plurality of electrodes and configured to step-up a predetermined voltage as an input voltage. The pulse controller is also configured to control the time required for energization of one pair of electrodes of the plurality of electrodes at a time. Further, the pulse controller is configured control duration of a plasma are of the plurality of plasma arcs inside the chamber.

In accordance with another embodiment a method for operating the device for treating the exhaust gases of a vehicle is provided. The method includes allowing, by a chamber, to burn or ionize a plurality of combustible constituents present in the exhaust gas to pass through the chamber. The method also includes providing, a plurality of electrodes positioned in the chamber. Further, the method includes positioning, each pair of the plurality of electrodes opposite to each other with a predetermined gap between each electrode of the pair plurality of electrodes. Furthermore, the method includes arranging, the plurality of electrodes in a direction perpendicular to the direction of the exhaust gas flow. Furthermore, the method includes generating, by the plurality of electrodes, a plurality of plasma arcs upon energizing the plurality of electrodes, wherein the plasma arc ionizes the exhaust gas to reduce emissions as the exhaust gas exits from a tail pipe of the vehicle thereby controlling the emissions of the vehicle. Furthermore, the method includes stepping-up, by a pulse controller, a predetermined voltage as an input voltage. Furthermore, the method includes controlling, by the pulse controller, the time required for energizing one pair of electrodes at a time. Furthermore, controlling, by the pulse controller, duration of a plasma arc of the plurality of plasma arcs inside the chamber.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which.

Figure 1:
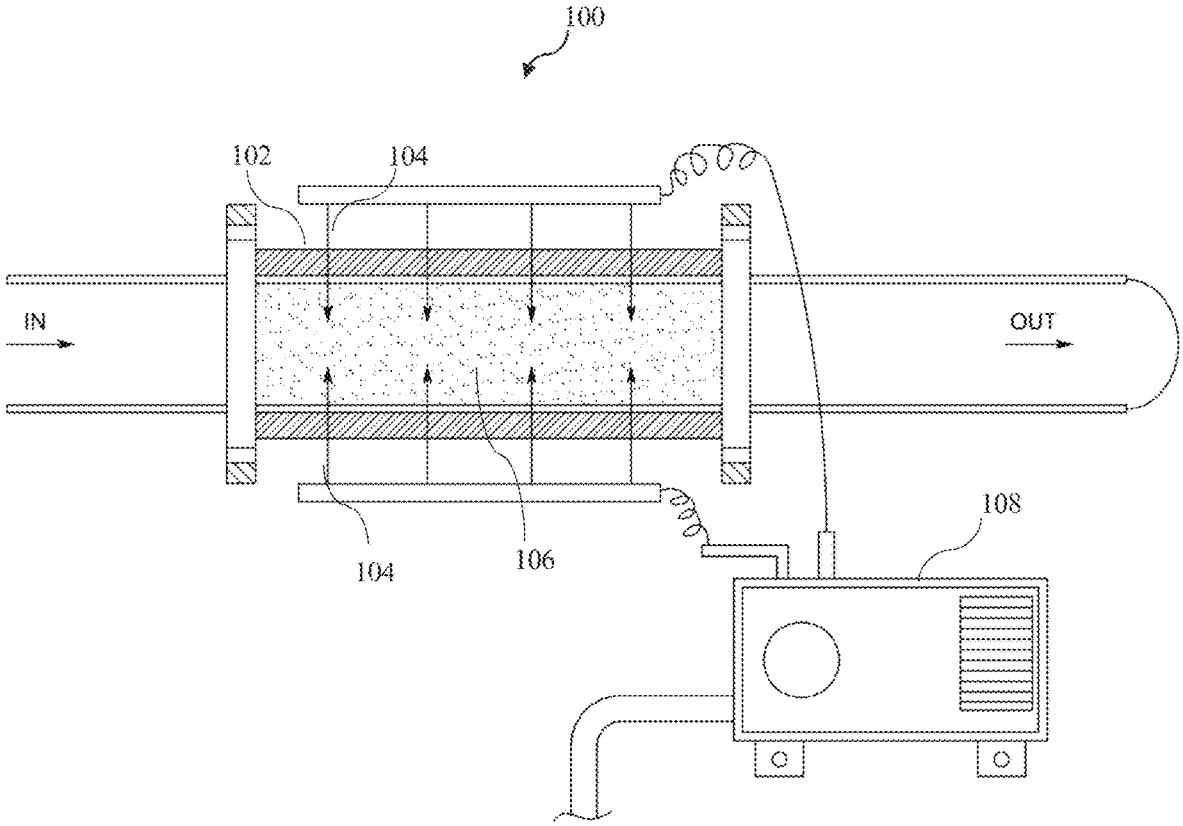
FIG. 1 is a schematic representation of a device for treating exhaust gases from a vehicle in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated system, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures, or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relate to a device for treating exhaust gas from a vehicle. The device includes a chamber, a plurality of electrodes, and a pulse controller. The chamber configured to allow at least one of burning and ionization of a plurality of combustible constituents present in the exhaust gas to pass through the chamber. The plurality of electrodes positioned in the chamber. Each pair of the plurality of electrodes is positioned opposite to each other with a predetermined gap between each electrode of the pair plurality of electrodes. The plurality of electrodes is arranged in a direction perpendicular to the direction of the exhaust gas flow. The plurality of electrodes is configured to generate a plurality of plasma arcs upon energizing the plurality of electrodes. The plasma arc ionizes the exhaust gas to reduce emissions as the exhaust gas exits from a tail pipe of the vehicle thereby controlling the emissions of the vehicle. The pulse controller electronically connected to the plurality of electrodes and configured to step-up a predetermined voltage as an input voltage. The pulse controller is also configured to control the time required for energization of one pair of electrodes of the plurality of electrodes at a time. Further, the pulse controller is configured control duration of a plasma are of the plurality of plasma arcs inside the chamber.

FIG. 1 is a schematic representation of a device 100 for treating exhaust gases from a vehicle in accordance with an embodiment of the present disclosure. The device 100 includes a chamber 102, a plurality of electrodes 104, and a pulse controller 108.

The chamber 102 is configured to allow at least one of burning and ionization of a plurality of combustible constituents present in the exhaust gas that passes through the chamber 102. In one embodiment, the chamber 102 is configured to allow ionization of carbon monoxide, carbon dioxide, smoke trade off, nitrogen oxide, and hydrocarbon present in the exhaust gas by the plurality of plasma arcs 106 generated by the plurality of electrodes 104. It must be noted that the plurality of plasma arcs 106 is generated with high voltage for the combustion of the exhaust gas. In one embodiment, the chamber 102 is also configured convert the exhaust gases to oxygen, nitrogen, water and carbon dioxide respectively.

The plurality of electrodes 104 is positioned in the chamber 102. Each pair of the plurality of electrodes 104 is positioned opposite to each other with a predetermined gap between each electrode of the plurality of electrodes 104.

The plurality of electrodes 104 is arranged perpendicular to the direction of the exhaust gas flow. The plurality of electrodes 104 is configured to generate a plurality of plasma arcs 106 upon energizing the plurality of electrodes 104. The plasma arc ionizes the exhaust gas to reduce emissions as the exhaust gas exits from a tail pipe of the vehicle thereby controlling the emissions of the vehicle.

In one embodiment, the plurality of electrodes (104) is connected to a power supply through the pulse controller (108). In one embodiment, the plurality of plasma arcs (106) is generated in a specific designed sequence for a secured burning of unburnt constituents in the exhaust gases by an electronic controller, wherein the secured burning of unburnt constituents corresponds to the natural flow of the unburnt constituents inside the chamber (102).

Further, the pulse controller 108 is configured to step-up a predetermined voltage as an input voltage. The pulse controller 108 is also configured to control the time required for energization of each pair of electrodes sequentially. Further, the pulse controller 108 is configured to control duration of the plurality of plasma arcs 106 inside the chamber 102.

Figure 2:
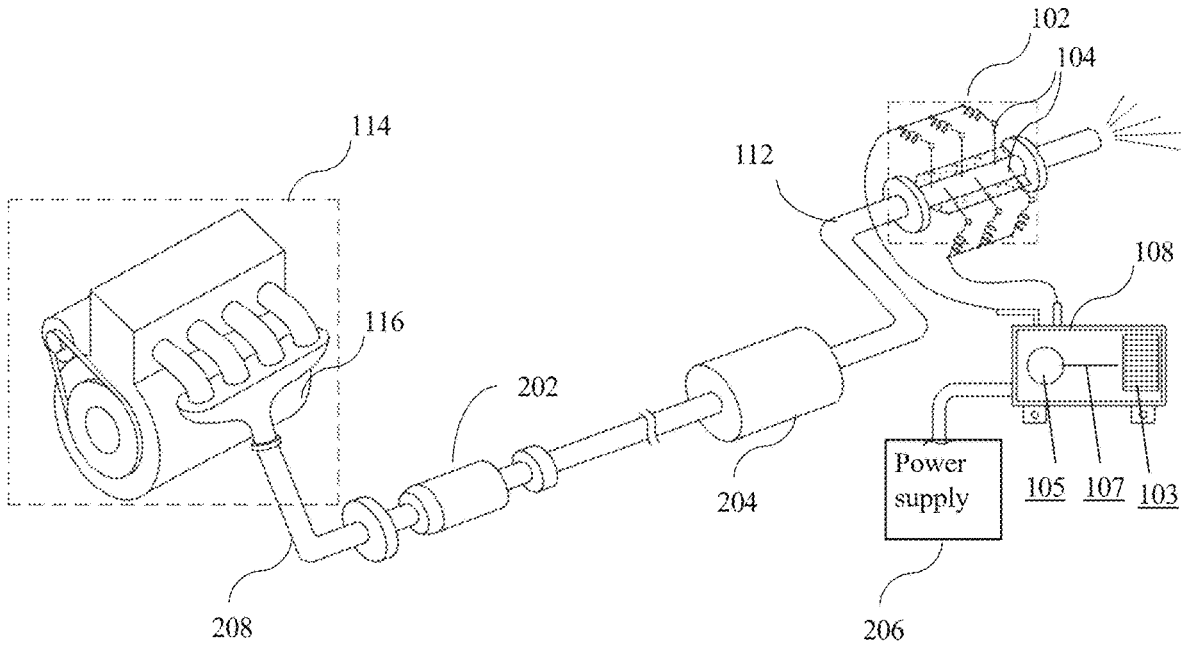
FIG. 2 is a schematic representation of the device mounted to a tail pipe of the vehicle of FIG. 1 in accordance with an embodiment of the present disclosure.

FIG. 2 is a schematic representation of the device 100 mounted to a tail pipe 112 of the vehicle of FIG. 1 in accordance with an embodiment of the present disclosure. The device 100 attached to the tail pipe 112 of the engine 114 of the vehicle. The tail pipe 112 is connected to an exhaust manifold 116 from where the exhaust gases are emitted. The plasma arc 106 is generated in pulses which is controlled by the pulse controller 108. In the chamber 102, the plasma burns out the carbon particulates at low temperatures and also reduces the NOx in the chamber 102. The device 100 is configured to remove NOx—smoke and the reduce of both NOx and particulate emissions. The plurality of electrodes 104 is connected to the power supply 206 through a pulse controller 108. The plasma is generated by an arcing effect, which helps in reducing particulates as well as dissociation of the NOx into nitrogen and oxygen.

In one embodiment, the internal combustion (IC) engine 114 is connected to the exhaust manifold 116. In one embodiment, the exhaust manifold 116 collects the exhaust gas from multiple cylinders of the vehicle and passes it to an exhaust pipe 208. The exhaust manifold 116 carries the exhaust gas from the engine 114 to the catalytic convertor 202. In one embodiment, the catalytic converter 202 converts unburnt hydrocarbons (HC), nitrogen oxides (NOx), and carbon monoxide (CO) into carbon dioxide (CO2) and water vapour (H2O) by oxidation. This process also reduces Oxides of Nitrogen (NOx) by converting into N2 and O2 respectively. The catalytic converter 202 is connected to a muffler 204. The muffler 204 is further connected to the tail pipe 112. The muffler 204 is configured to reduce the noise of the exhaust gases to a pre-defined level.

The device 100 is attached to the exhaust pipe with no restriction to the vehicular exhaust gas flow, pressure, and other physical properties. The chamber 102 with the plurality of electrodes 104 is positioned to maximize the after burning of combustible constituents in the exhaust gases passing through. The plurality of electrodes 104 in a specific designed sequence & position for a secured and efficient burning of unburnt constituents in the exhaust gases in their natural flow inside the chamber 102, with power connections and electrical bus bars. The device includes a pulse controller 108 which provides high voltage input to the electrode banks in a specific alternate sequence. The power supply 206 to the pulse controller 108 is from the vehicle electric power, however the voltage is stepped-up to 100 kV for the purpose of high voltage plasma generation. In one embodiment, a plurality of electrical bus bars, insulations, and attachments in a compact design fitting, wherein the compact design fitting is adaptable to the tail pipe 112 of the vehicle. The device works on an afterburner concept, attached to the automotive tail pipe 112. The system works on the principles of burning the unburnt combustible constituents and ionizing the gases using a plasma arc 106 which results in reduced tail pipe 112 emissions. The plasma are with an electronically controlled pulse controller 108 for controlled burning of combustible constituents in the exhaust which may burn out the residual exhaust gas. This minimizes harmful gases and carbon particulates being emitted into the atmosphere.

Figure 3:
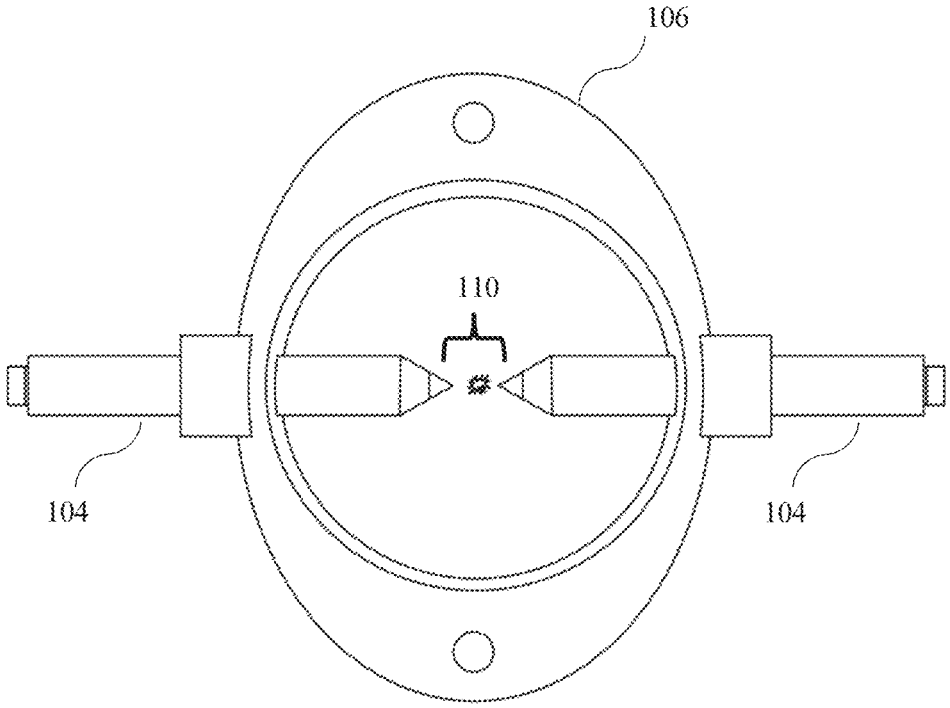
FIG. 3 is a schematic representation of a plasma arc generated by a pair of electrodes of FIG. 1 in accordance with an embodiment of the present disclosure.

FIG. 3 is a schematic representation of a generated plasma arc 106 by a pair of electrodes of FIG. 1 in accordance with an embodiment of the present disclosure. In one embodiment, the pair of electrodes 104 are placed at a specific distance 110 from each other. In one embodiment, the distance 110 is 10 mm to 12 mm.

Figure 4:
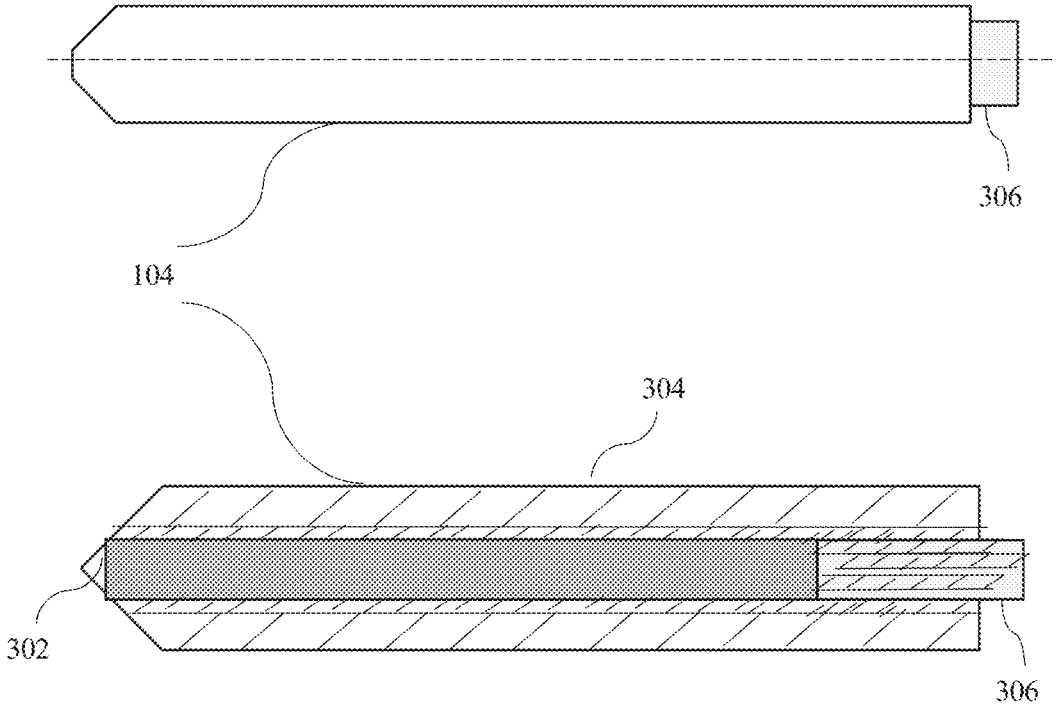
FIG. 4 is a cross-sectional view of the pair of electrodes of FIG. 3 in accordance with an embodiment of the present disclosure.

FIG. 4 is a cross-sectional view of a pair of electrodes 104 of FIG. 1 in accordance with an embodiment of the present disclosure. In one embodiment, a core 302 of an electrode is composed of graphite, wherein the graphite has high electrical and thermal conductivity. In another embodiment, the electrode includes a sleeve 304, wherein the sleeve is a copper tube for good conductivity. Yet, in one embodiment, the electrode includes insulation 306 between the sleeve 304 and the core 302 for providing insulation to the copper and the graphite. In one embodiment, the insulation 306 material is ceramic.

Figure 5:
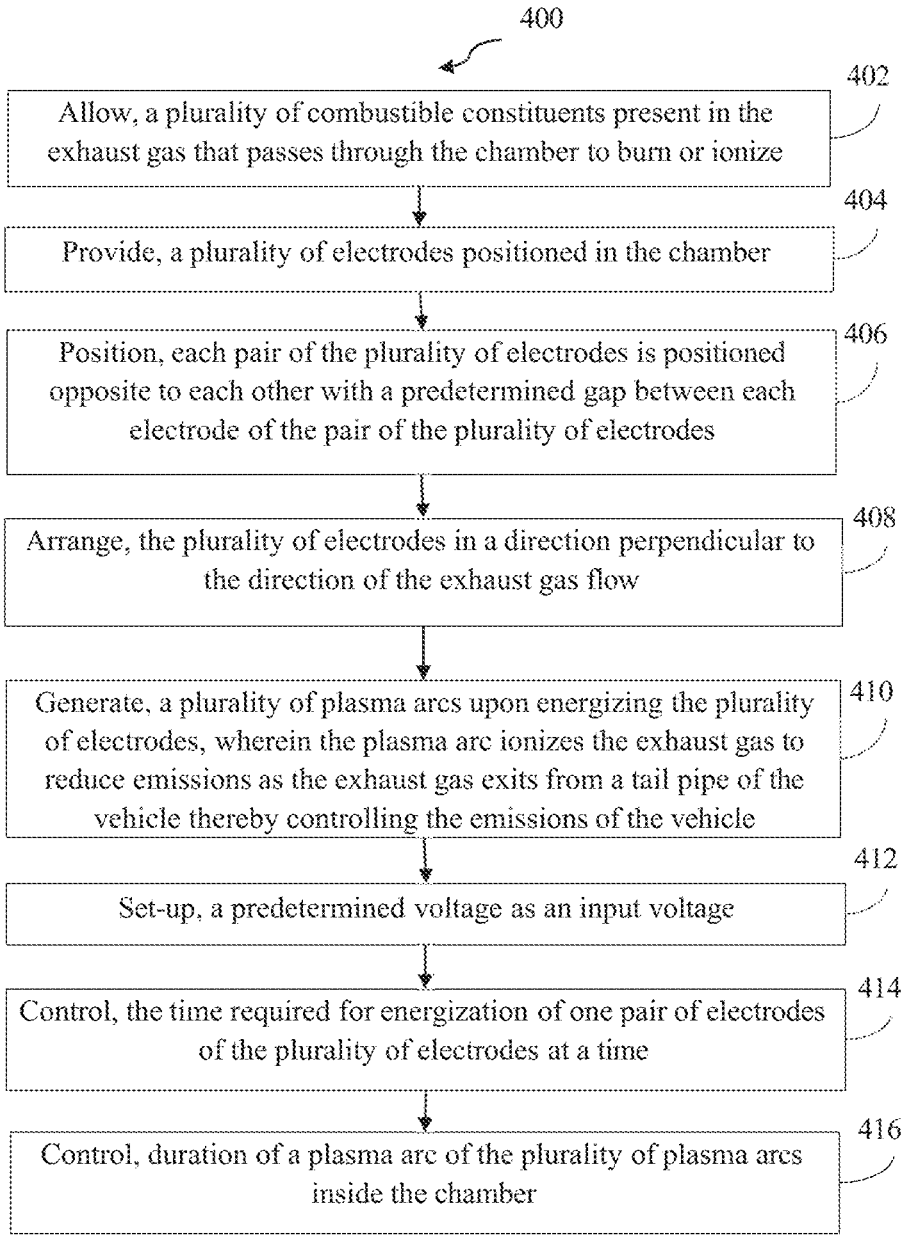
FIG. 5 is a flow chart representing steps involved in a method for operating the device for treating exhaust gases from a vehicle in accordance with an embodiment of the present disclosure.

FIG. 5 is a flow chart representing steps involved in a method 400 of operation of the device for treating the exhaust gas from a vehicle. As a pre-requisite, the method includes coupling the device to a tail pipe of an engine of the vehicle. Typically, the tail pipe is connected to an exhaust manifold from where the gases are emitted.

The method includes allowing, by a chamber, to burn or ionize a plurality of combustible constituents present in the exhaust gas that passes through the chamber in step 402. The method also includes allowing, ionization of carbon monoxide, carbon dioxide, smoke trade off, nitrogen oxide, and hydrocarbon present in the exhaust gas by the plurality of plasma arcs generated by the plurality of electrodes. The method also includes converting, the exhaust gases to oxygen, nitrogen, water and carbon dioxide respectively.

The method 400 also includes providing, a plurality of electrodes positioned in the chamber in step 404. The method also includes connecting the plurality of electrodes toa power supply through the pulse controller.

Further, the method 400 includes positioning, each pair of the plurality of electrodes is positioned opposite to each other with a predetermined gap between each electrode of the pair plurality of electrodes in step 406.

Furthermore, the method 400 includes arranging, the plurality of electrodes the plurality of electrodes is arranged in a direction perpendicular to the direction of the exhaust gas flow in step 408.

Furthermore, the method 400 includes generating, by the plurality of electrodes, a plurality of plasma arcs upon energizing the plurality of electrodes, wherein the plasma arc ionizes the exhaust gas to reduce emissions as the exhaust gas exits from a tail pipe of the vehicle thereby controlling the emissions of the vehicle in step 410. The method also includes burning, by the plurality of plasma arcs of the plurality of electrodes, unburnt constituents in the exhaust gases, wherein the secured burning of unburnt constituents is corresponding to the natural flow of the unburnt constituents inside the chamber.

Furthermore, the method 400 includes stepping-up, by a pulse controller, a predetermined voltage as an input voltage in step 412. The method also includes stepping-up the voltage to 100 kV for the purpose of high voltage plasma generation.

Furthermore, the method 400 includes controlling, by the pulse controller, the time required for energization of one pair of electrodes of the plurality of electrodes at a time in step 414.

Furthermore, the method 400 includes controlling, by the pulse controller, duration of a plasma are of the plurality of plasma arcs inside the chamber in step 416.

Various embodiments of the present disclosure enable treating of harmful exhaust gases from the vehicle. The device disclosed in the present disclosure burns out the residual exhaust gas, harmful gases, and carbon particulates internally before being emitted into the atmosphere. The device does not affect the performance of the vehicle's engine or other performance related parameters. Consequently, the exhaust emission levels are improved. The device in the present disclosure provides improved exhaust emissions by burning harmful gases. The device disclosed in the present disclosure provides a compact design for fitting in a small space adaptable to the existing automobile exhaust tailpipe packaging. Further, the device aids to sustain IC engines.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

We claim:

1. A device for treating exhaust gas from a vehicle comprising:

a chamber configured to allow at least one of burning and ionization of a plurality of combustible constituents present in the exhaust gas to pass through the chamber;

a plurality of electrodes positioned in the chamber, each electrode comprises:

a graphite core extending along a longitudinal axis:

a ceramic insulation layer surrounding at least a portion of the graphite core;

a copper sleeve disposed around the ceramic insulation, wherein a terminal portion of the graphite core extends beyond both the ceramic insulation and the copper sleeve, defining an exposed end configured for plasma discharge; and wherein each pair of the plurality of electrodes is positioned opposite to each other with a predetermined gap between each electrode of the pair plurality of electrodes, wherein the plurality of electrodes is arranged in a direction perpendicular to the direction of the exhaust gas flow, and wherein the plurality of electrodes is configured to generate a plurality of plasma arcs upon energizing the plurality of electrodes, wherein the plasma arc ionizes the exhaust gas to reduce emissions as the exhaust gas exits from a tail pipe of the vehicle thereby controlling the emissions of the vehicle; and a pulse controller electronically connected to the plurality of electrodes and configured to:

step-up a predetermined voltage as an input voltage;

control the time required for energization of one pair of electrodes of the plurality of electrodes at a time; and control duration of a plasma arc of the plurality of plasma arcs inside the chamber.

2. The device as claimed in claim 1, is operatively coupled with a tail pipe of an engine of the vehicle, wherein the tail pipe is connected to an exhaust manifold from where the gases are exhausted.

3. The device as claimed claim 1, wherein the chamber is configured to:

allow ionization of carbon monoxide, carbon dioxide, smoke trade off, nitrogen oxide, and hydrocarbons present in the exhaust gas by the plurality of plasma arcs generated by the plurality of electrodes; and convert the exhaust gases to oxygen, nitrogen, water and carbon dioxide.

4. The device as claimed in claim 1, wherein the plurality of electrodes is connected to a power supply through the pulse controller.

5. The device as claimed in claim 1, wherein the plurality of plasma arcs of the plurality of electrodes is generated in a specific designed sequence for a secured burning of unburnt constituents in the exhaust gases, wherein the secured burning of unburnt constituents is corresponding to the natural flow of the unburnt constituents inside the chamber.

6. A method for operating the device for treating the exhaust gases of a vehicle comprising:

allowing, by a chamber, to burn or ionize a plurality of combustible constituents present in the exhaust gas that pass through the chamber;

providing, a plurality of electrodes positioned in the chamber, each electrode comprises:

a graphite core extending along a longitudinal axis;

a ceramic insulation layer surrounding at least a portion of the graphite core;

a copper sleeve disposed around the ceramic insulation, wherein a terminal portion of the graphite core extends beyond both the ceramic insulation and the copper sleeve, defining an exposed end configured for plasma discharge;

positioning, each pair of the plurality of electrodes opposite to each other with a predetermined gap between each electrode of the pair plurality of electrodes;

arranging, the plurality of electrodes in a direction perpendicular to the direction of the exhaust gas flow;

generating, by the plurality of electrodes, a plurality of plasma arcs upon energizing the plurality of electrodes, wherein the plasma arc ionizes the exhaust gas to reduce emissions as the exhaust gas exits from a tail pipe of the vehicle thereby controlling the emissions of the vehicle;

stepping-up, by a pulse controller, a predetermined voltage as an input voltage;

controlling, by the pulse controller, the time required for energizing one pair of electrodes of the plurality of electrodes at a time; and controlling, by the pulse controller, duration of a plasma arc of the plurality of plasma arcs inside the chamber.

* * * * *